United States Patent [19]

Murta

[11] Patent Number: 4,588,347

[45] Date of Patent: May 13, 1986

[54] TELESCOPIC BOOMS

[75] Inventor: Raymond Murta, Warrington, England

[73] Assignee: Coles Cranes Limited, Crown Works, England

[21] Appl. No.: 421,547

[22] Filed: Sep. 22, 1982

[30] Foreign Application Priority Data

Oct. 2, 1981 [GB] United Kingdom ..... 8129852

[51] Int. Cl.[4] ..... B66C 15/00

[52] U.S. Cl. ..... 414/685; 414/718; 212/149; 212/153; 901/49

[58] Field of Search ..... 212/149, 153, 267; 414/718, 680; 901/50, 49

[56] References Cited

U.S. PATENT DOCUMENTS

| | | | |
|---|---|---|---|
| 3,055,459 | 9/1962 | Eitel | 212/149 X |
| 3,265,360 | 8/1966 | Tax | 212/149 X |
| 3,282,449 | 11/1966 | Buford | 212/149 X |
| 3,502,228 | 3/1970 | Tamborino | 212/149 |

FOREIGN PATENT DOCUMENTS

| | | | |
|---|---|---|---|
| 819048 | 4/1981 | U.S.S.R. | 212/149 |

*Primary Examiner*—Joseph E. Valenza
*Assistant Examiner*—Terrance L. Siemens
*Attorney, Agent, or Firm*—Townsend and Townsend

[57] ABSTRACT

A telescopic boom for a crane, access platform or the like comprises at least three telescopic boom sections the intermediate section being arranged to be extended by a hydraulic ram while the outer section being arranged to be extended by a pulley and chain arrangement. A telescoping boom safety system includes a wire rope and a pair of linked drag chains which extend from a first anchorage on the outer section around a guide to a second anchorage on the base section. Failure of the pulley and chain arrangement causes the safety system to prevent or contain relative movement of the outer and intermediate sections and thereby stop sudden and catastrophic retraction of the outer section.

13 Claims, 4 Drawing Figures

TELESCOPIC BOOMS

BACKGROUND OF THE INVENTION

The present invention relates to telescopic booms. Telescopic booms with three or more sections are often used with mobile cranes or with access or work platforms and such booms use a chain or other suitable extension means to extend and contract the outer telescopic boom section. The extension and retraction of intermediate telescopic section(s) is usually by means of a hydraulic cylinder, which in turn causes the extension or retraction of the outer telescopic section by means of the chain or other suitable extension means. Such a system is well known in the industry, and has been used successfully for many years.

The major disadvantage of the use of a chain or other suitable extension means is that mechanical failure of the extension chain or extension means itself or its end attachments may allow sudden and catastrophic retraction of the section being supported, with the possibility of causing death or serious injury to the occupants of an access platform, or others in the vicinity.

Regulatory Authorities in some countries have recognised this danger, and have dictated in particular that access platform booms which incorporate chain systems must be provided with a safety device, which in the event of extension chain failure arrests the linear motion of the boom within 100 mm and also causes the power source—i.e. the engine—to be shut down.

An object of the present invention is to mitigate or overcome one or more of the above problems.

SUMMARY OF THE INVENTION

A telescopic boom according to the present invention comprises at least three telescopic boom sections namely an outer section, an intermediate section and a base section, extension means arranged to extend the intermediate section, second extension means arranged to extend the outer section, and flexible safety retaining means extending from a first anchorage on the lower portion of the outer section outwards and around a guide at or adjacent the outer end of the intermediate section and inwardly towards or beyond the foot of the intermediate section to a fixed second anchorage to prevent or contain relative movement of the outer and intermediate boom sections if failure of the second extension means occurs.

Preferably the second anchorage is on the base section at the outer end thereof. In the preferred embodiment means are provided to detect tensioning of the retaining means and consequently either lock the extension means in the extended position to prevent movement of the intermediate section relative the base section and/or immobilise the vehicle supporting the telescopic boom.

The safety retaining means is provided with a resilient member, preferably a spring, so that the retaining means is resiliently attached to the second anchorage. A safety switch may be provided at or adjacent the second anchorage so that when the retaining means is suddenly tensioned, movement of the retaining means relative the second anchorage is detected if failure of the second extension means occurs.

Preferably in the event of failure of the second extension means the relative movement of the boom sections is arrested to within 0.1 m.

BRIEF DESCRIPTION OF THE DRAWINGS

The invention is illustrated in the accompanying drawings, wherein.

DESCRIPTION OF THE PREFERRED EMBODIMENT

Figure 1:
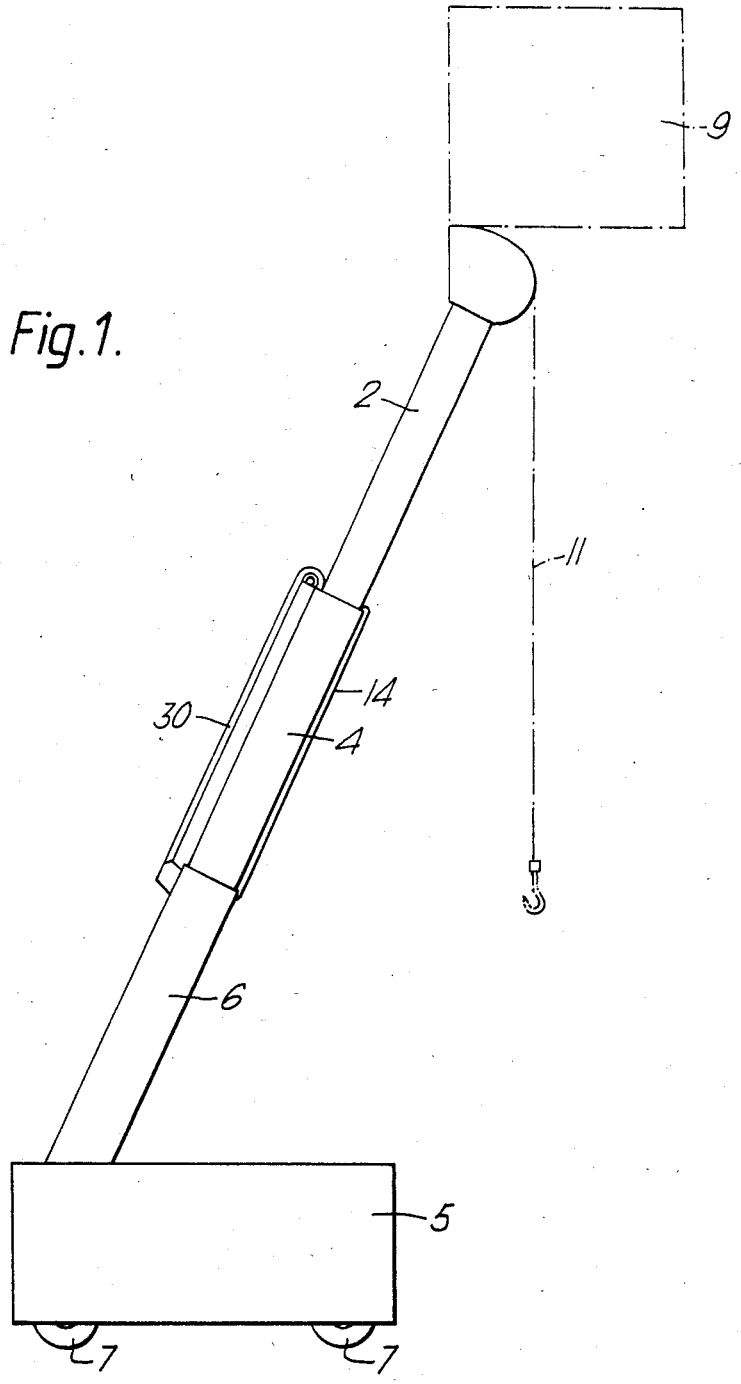
FIG. 1 shows a vehicle in accordance with the invention.

In FIG. 1 there is shown a vehicle with a body 5, wheels 7 and a telescopic boom (2, 4 and 6). The head of the boom either supports a rope and hook 11 when the vehicle is a mobile crane or supports a platform 9 when the vehicle is an access platform vehicle.

Figure 2:
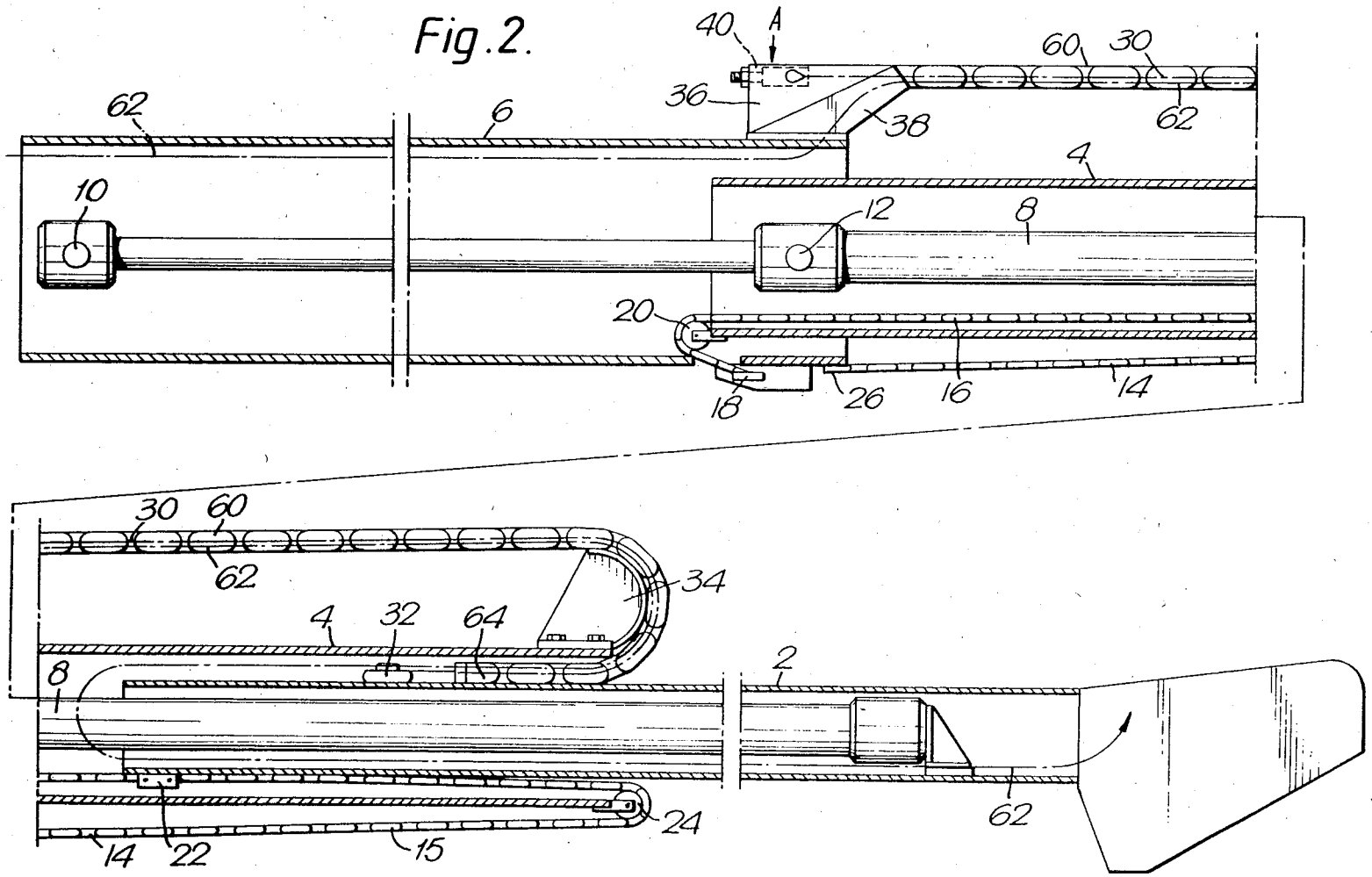
FIG. 2 is a diagrammatic cross section of a telescopic boom used on the vehicle of FIG. 1.
Figure 3:
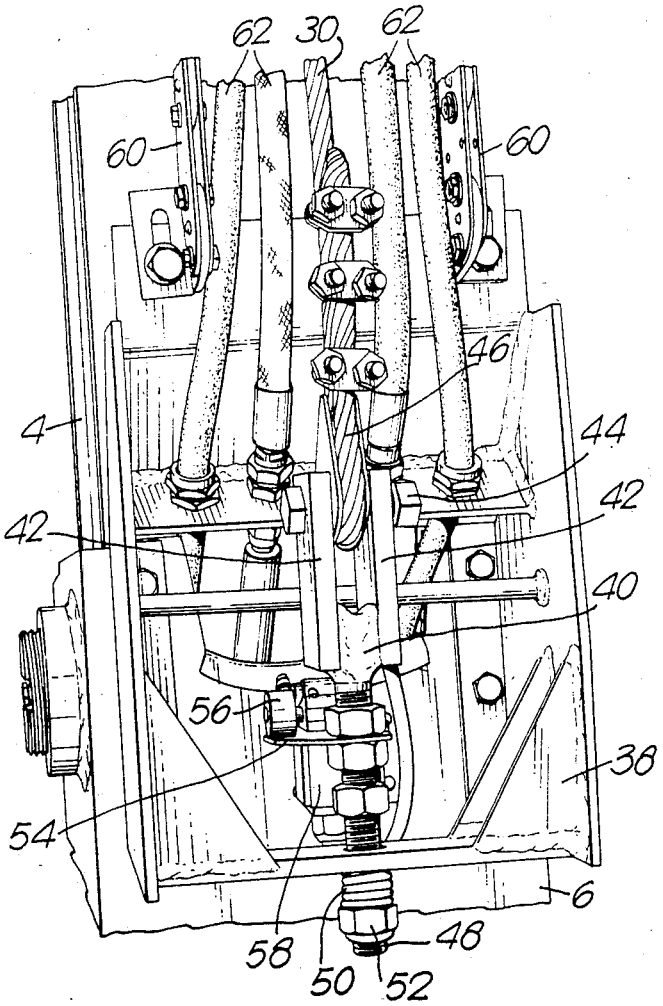
FIG. 3 is a plan view of an anchorage point as viewed from direction A on the base section of the telescopic boom of FIG. 2.

In FIGS. 1 and 2 the telescopic boom is shown comprising an outer boom section 2 telescoping within an intermediate section 4 which in turn telescopes within a base boom section 6. The intermediate section 4 is extended by first extension means namely a hydraulic ram 8 acting between the foot of the base section 6 at a point 10 and the base of the intermediate section at a point 12. The outer boom section 2 is extended by second extension means namely a known chain arrangement in which a chain 14 which may have two parts, namely an outer chain part 15 and an inner chain part 16. The inner chain part 16 is anchored to the base section at a point 18, passes around a guide, preferably a pulley 20, at the foot of the intermediate section 4 and outwardly to an anchorage 22 at the foot of the boom section 2. The outer chain part 15 extends from the anchorage 22 around a guide, preferably a pulley 24 at the outer end of the intermediate section 4 and part to an anchorage point 26 at the head of the base section 6.

Chain 14 with its two parts 15 and 16 forms a flexible extension means for extending the outer section in a known way. Failure of the extension means 14 either in the chain or at any of the anchorage points 18, 22 or 26 without any safety device can cause catastrophic retraction of the outer boom section 2.

A flexible safety retaining means, in this case a wire rope 30 extends from an anchorage 32 on the outer boom section 2 around a guide means, in this case a deflector bracket 34 at the head of the intermediate section 4 and then from the bracket 34 inwardly and towards the foot of the intermediate section to a second anchorage 36 at the head of the base section 6. The second anchorage 36 comprises a racket 38 to the base of which is mounted a fork member 40 having arms 42 through which a securing bolt 44 passes to secure a terminal eye 46 at the end of rope 30. The fork member 40 has a screwed shank 48 which passes through the bracket 38 and on which a spring 50 is mounted. On the end of the shank 48 there is provided a nut 52 retaining the shank on the bracket and against which spring 50 acts.

Figure 4:
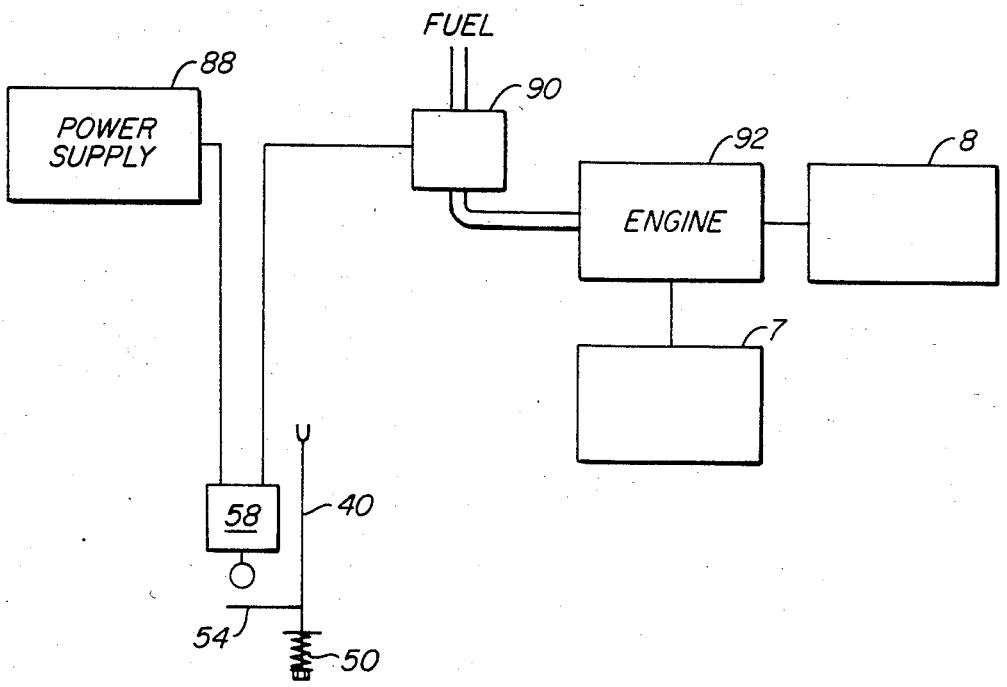
FIG. 4 is a schematic representation showing the power interruption circuit.

There is further provided on the shank 48 of the fork member 40 a plate 54 which acts on a switch arm 56 of a switch 58 which is arranged to interrupt a power supply 88 (See FIG. 4) to a fail safe engine fuel solenoid 90. The vehicle carrying the telescopic boom is consequently immobilised as the engine 92 is shut down.

Additionally the switch 58 is arranged to lock the hydraulic ram 8 in its extended position and prevent movement of the intermediate section relative the base section.

Also attached to the bracket 38 is a pair of linked drag chains 60 between which are guide hoses 62 which may be fitted to the boom arrangement for powering devices at the head of the boom arrangement or for use for controlling the boom arrangement when an access platform is fitted to the outer boom section 2 (see U.S. application Ser. No. 368,255 filed Apr. 14, 1982). The drag chains 60 pass around the bracket 34 to an anchorage point 64 adjacent anchorage point 32 on the outer boom section 2.

The bracket 34 has a curved surface which matches approximately the minimum natural bend radius of the drag chain 60 in its unsupported form. A clearance of approximately 10 mm is provided between the curved face of the bracket and the drag chain.

The steel rope 30 is adjusted so that in the normal operating condition the load in the rope is small and the spring 50 at the second anchorage 36 is compressed approximately 50%.

In the event of the failure of the flexible extension means 14 the weight of the outer section 2 will be taken by the steel rope causing the drag link chain to make contact with the bracket 34 and causing compression of the spring 50 at the second anchorage. The motion of the outer section 2 will thus be arrested. The slight movement of the cable 30 relative to the bracket 38 at the second anchorage being utilized to activate the limit switch 58 which in turn shuts down the power source.

Tests carried out on the boom arrangement as above resulted in the outer boom section 2 being arrested within 55 mm of its initial position.

It will be appreciated that the safety arrangement is suitable for any telescoping boom arrangement either used for the crane or access platform or any other suitable purpose and is not restricted to use with the type of power extension means described.

The term outer section is used above as a purely relative term relative to the intermediate section or base sections. That is to say there may be further outer sections, for example a telescopic boom with four sections wherein the second extension means are provided to extend the third and "outer" section will have a fourth and further outer section. In such a case the fourth section may also be extended by the second extension means. Also the invention is not limited to an arrangement having only one intermediate section but other intermediate sections may be provided. For example a telescopic boom with four sections wherein the second extension means are provided to extend the fourth and outer section will have two intermediate sections one or both of which are extended by the first extension means.

I claim:

1. An access platform apparatus comprising:

a body, a plurality of wheels attached to said body, a telescopic boom supported by said body and comprising at least:

a base boom section mounted to said body, an intermediate boom sectionry telescopically mounted within said base boom section, said sectionry comprising at least one intermediate boom, an outer boom section telescopically mounted within said intermediate sectionry, first extension means arranged to extend said intermediate sectionry, second extension means arranged to extend said outer boom section, a first anchorage on a lower portion of said outer section, a guide at or adjacent an outer end of said intermediate sectionry, a second anchorage located in a direction from the outer end of said intermediate sectionry towards said body, flexible safety retaining means, extending between said first and second anchorage and around said guide, for halting relative movement of said outer boom section and said intermediate sectionry upon failure of said second extension means.

2. A mobile crane apparatus comprising:

a body, a plurality of wheels attached to said body, a telescopic boom supported by said body and comprising at least:

a base boom section mounted to said body, an intermediate boom sectionry telescopically mounted within said base boom section, said sectionry comprising at least one intermediate boom, an outer boom section telescopically mounted within said intermediate sectionry, first extension means arranged to extend said intermediate sectionry, second extension means arranged to extend said outer boom section, a first anchorage on a lower portion of said outer section, a guide at or adjacent an outer end of said intermediate sectionry, a second anchorage located in a direction from the outer end of said intermediate sectionry towards said body, flexible safety retaining means, extending between said first and second anchorage and around said guide, for halting relative movement of said outer boom section and said intermediate sectionry upon failure of said second extension means.

3. A telescopic boom apparatus comprising at least:

a base boom section, an intermediate boom sectionry telescopically mounted within said base boom section, said sectionry comprising at least one intermediate boom, an outer boom section telescopically mounted within said intermediate sectionry:

first extension means arranged to extend said intermediate sectionry, second extension means arranged to extend said outer boom section, a first anchorage on a lower portion of said outer section, a guide at or adjacent an outer end of said intermediate sectionry, s a second anchorage on the base boom section, flexible safety retaining means, extending between said first and second anchorage and around said guide, for halting relative movement of said outer boom section and said intermediate sectionry upon failure of said second extension means.

4. An apparatus as claimed in either claim 1 or 2 or 3 wherein the second anchorage is on said base section at the outer end thereof.

5. An apparatus as claimed in either claim 1 or 2 or 3 wherein switch means are provided to detect tensioning of said retaining means.

6. An apparatus as claimed in claim 5 wherein said means is a safety switch at or adjacent said second anchorage which detects movement of said retaining means relative said second anchorage if failure of said second extension means occurs.

7. An apparatus as claimed in either claim 1 or 2 or 3 wherein said safety retaining means is provided with a resilient member, so that said retaining means is resiliently attached to said second anchorage.

8. An apparatus as claimed in either claim 1 or 2 or 3 wherein in the event of failure of said second extension means the relative movement of said outer and intermediate boom sections is arrested to within 0.1 m.

9. An apparatus as claimed in either claim 1 or 2 or 3 wherein said second extension means is a chain system.

10. An apparatus as claimed in either claim 1 or 2 or 3 wherein said guide is a deflector bracket at or adjacent the outer end of said intermediate sectionry.

11. The apparatus of claim 3 wherein said first extension means includes a hydraulic ram.

12. Apparatus as claimed in claims 1 or 2 or 3 wherein said safety retaining means has associated therewith and movable thereby an actuating member arranged to actuate a safety switch associated with an engine cut out means, whereby on failure of said second extension means power to said first extension means is halted.

13. Apparatus as claimed in claim 12 wherein said safety switch is positioned at or adjacent said second anchorage, wherein said actuating member is mounted to a resiliently mounted member forming a part of said second anchorage, and wherein said safety retaining means is connected to said resiliently mounted member and said resiliently mounted member is resiliently mounted to said outer end of said intermediate sectionry.

* * * * *